US006213275B1

(12) United States Patent
Lonardi et al.

(10) Patent No.: US 6,213,275 B1
(45) Date of Patent: Apr. 10, 2001

(54) DEVICE FOR DISTRIBUTING MATERIALS IN BULK WITH A ROTARY CHUTE HAVING A VARIABLE ANGLE OF INCLINATION

(75) Inventors: Emile Lonardi, Bascharage; Giovanni Cimenti, Fentange, both of (LU)

(73) Assignee: Paul Wurth S.A., Luxembourg (LU)

( * ) Notice: Subject to any disclaimer, the term of this patent is extended or adjusted under 35 U.S.C. 154(b) by 0 days.

(21) Appl. No.: 09/438,536

(22) Filed: Nov. 12, 1999

(30) Foreign Application Priority Data

Nov. 16, 1998 (LU) ..... 90319

(51) Int. Cl.[7] ..... B65G 11/00

(52) U.S. Cl. ..... 193/16; 414/160; 266/176

(58) Field of Search ..... 193/2 R, 3, 16; 198/536; 414/160, 199, 206, 208; 266/176, 266, 184, 191, 196

(56) References Cited

U.S. PATENT DOCUMENTS 4,243,351 * 1/1981 Legille et al. ..... 193/16 X
4,368,813 * 1/1983 Mailliet ..... 193/3
4,547,116 * 10/1985 Legille et al. ..... 193/16 X
5,273,148 * 12/1993 Lonardi et al. ..... 193/16 X

* cited by examiner

*Primary Examiner*—James R. Bidwell
(74) *Attorney, Agent, or Firm*—Smith, Gambrell & Russell, LLP

(57) ABSTRACT

A device for distributing materials in bulk comprises a first rotor (20) and a second rotor (30). The first rotor (20) carries two suspension bearings (44, 46) in which a distribution chute (42) is suspended so that it can pivot about a substantially horizontal axis. A gear transmission (52), carried by the first rotor (20), includes an input shaft (54) and an output shaft (60). The input shaft is provided with a pinion (56) which meshes with an annular gear (58) of the second rotor (30). The output shaft of the transmission is parallel to the pivoting axis of the chute (42) and incorporates two cranks (64, 66). The chute (42) is provided with a pivoting lever (48, 50) at the level of each of its two suspension bearings (44, 46). Each of these two pivoting levers (48, 50) is symmetrically connected to one of the two cranks (64, 66) of the gear transmission (52) by a connecting rod (68, 70).

6 Claims, 2 Drawing Sheets

Fig. 1

Figure 1:
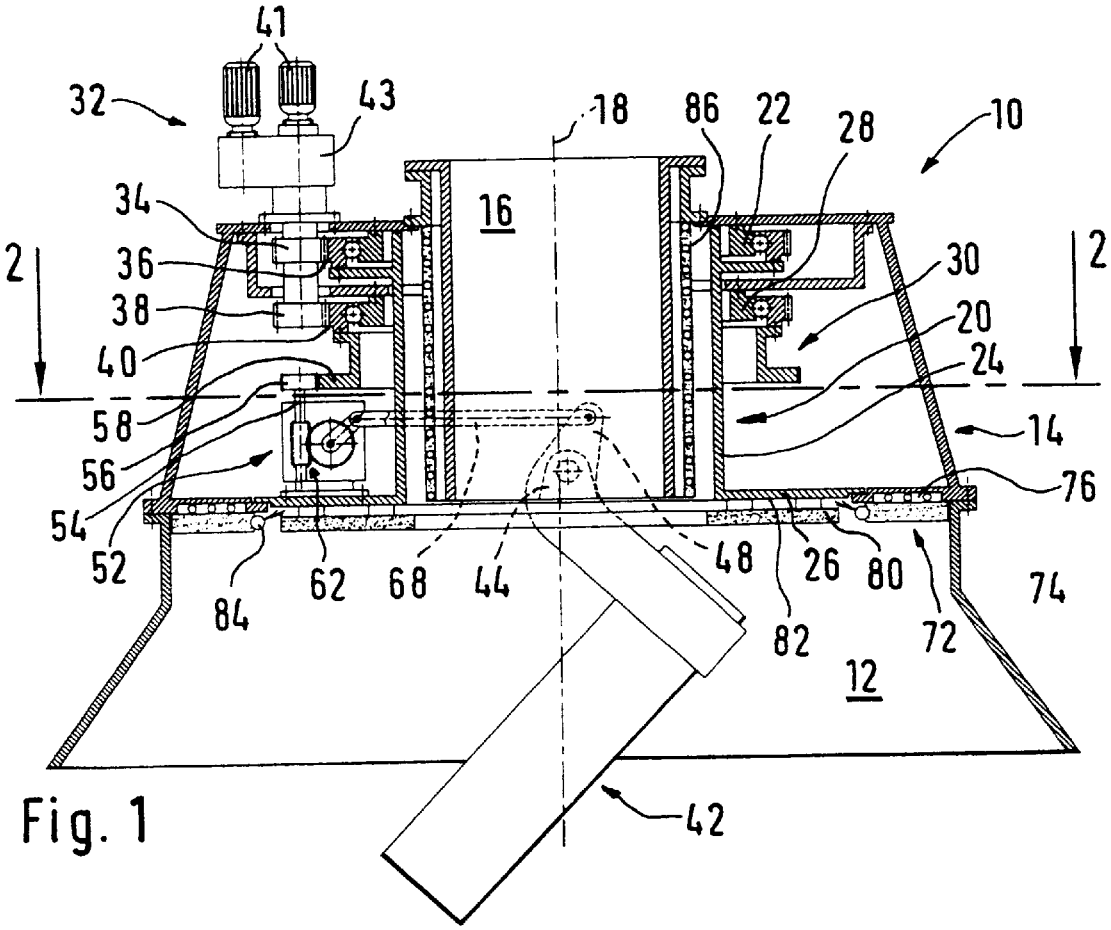

DEVICE FOR DISTRIBUTING MATERIALS IN BULK WITH A ROTARY CHUTE HAVING A VARIABLE ANGLE OF INCLINATION

The present invention relates to a device for distributing materials in bulk with a rotary chute having a variable angle of inclination. It relates more particularly to a device for distributing materials in bulk comprising a chute, a first rotor with a substantially vertical rotation axis, on which the chute is suspended so that it can pivot about a substantially horizontal pivoting axis, and a second rotor, having a rotation axis substantially coaxial with said first rotor.

Such devices for the distribution of materials in bulk are used, for example, in devices for charging shaft furnaces, particularly blast furnaces. The rotary and pivoting chute provides for the distribution of the charge over a charge surface inside the shaft furnace.

In the device described in the preamble, the first rotor essentially rotates the chute about a vertical axis. The second rotor interacts with the chute so as to fix its angle of inclination to the vertical. For this purpose, the second rotor is connected to the chute through a pivoting mechanism converting a variation in angular displacement between the two rotors into a variation in the angle of inclination of the chute in its vertical plane of pivoting.

Different variants have been proposed for the embodiment of this pivoting mechanism, which generates the torque required to pivot the chute about its horizontal pivoting axis and which transmits this torque to the chute.

The patent U.S. Pat. No. 3,766,868 proposes a device of the type described in the preamble in which a linking rod located in the pivoting plane of the chute is coupled at one end to the rear surface of the chute. The other end of this linking rod is guided in a sinusoidal guiding track on the second rotor.

The patent U.S. Pat. No. 3,814,403 proposes a device of the type described in the preamble in which the second rotor comprises an annular gear. The latter, through the intermediary of a first pinion, drives a worm which, through the intermediary of a second pinion, acts on a sector gear fixed laterally on to a suspension journal for the chute.

The document U.S. Pat. No. 4,368,813 proposes a device of the type described in the preamble in which the rotor also comprises an annular gear. The first rotor carries a worm drive. The input shaft of the latter is provided with a pinion which meshes with the annular gear of said second rotor. The output shaft is parallel to the pivoting axis of the chute and is equipped with a crank. A connecting rod. contained in the pivoting plane of the chute, is coupled at one end to the rear surface of the chute and at the other end to the crank.

The document U.S. Pat. No. 4,941,792 proposes two devices of the type described in the preamble. A first embodiment uses a pivoting lever supported by the first rotor so that it can pivot in the pivoting plane of the chute. This pivoting lever is connected to the second rotor by means of a linking rod having ball-and-socket joints. The chute comprises two lateral suspension journals each of which is provided with a crank. A forked linking rod connects the pivoting linking rod to the two cranks on the chute. In the second embodiment the second rotor supports an annular segment gear which cooperates with a sector gear attached to a lateral suspension journal on the chute.

The document U.S. Pat. No. 5,002,806 proposes a device of the type described in the preamble in which the second rotor is connected to a crank attached to a lateral suspension journal on the chute using a linking rod having ball-and-socket joints.

The objective of the present invention is to propose a simple and compact device making it possible to transmit large pivoting torques to the rotary chute. In conformity with the invention, this objective is achieved by a device according to claim 1.

A device for distributing materials in bulk according to the invention comprises a first rotor and a second rotor having a common substantially vertical rotation axis. Said first rotor carries two suspension bearings, in which a distribution chute is suspended so that it can pivot about a substantially horizontal pivoting axis. The device also comprises a gear transmission, which is also carried by said first rotor. This transmission comprises an input shaft and an output shaft. The input shaft is fitted with a pinion which meshes with an annular gear of said second rotor. The output shaft of the transmission is parallel to the pivoting axis of the chute. According to an important feature of the present invention, the output shaft incorporates two cranks, while the chute is fitted with a pivoting lever at the level of each of its suspension bearings. Each of these two pivoting levers is then connected to one of the two cranks of the gear transmission by means of a connecting rod. A difference between the angular rotational speed of the first rotor and that of the second rotor produces a rotation of the input pinion of the gear transmission about its own axis and hence also a rotation of the two cranks carried by the output shaft of the transmission. These two cranks then symmetrically transmit, through the intermediary of the above-mentioned pair of connecting rods and levers, the pivoting torque to the chute. This makes it possible to transmit large pivoting torques to the rotary chute with a simple and compact device.

Such a distribution device will usually comprise a fixed vertical charging duct positioned so as to pour the material in bulk into the chute. Said first rotor then advantageously comprises a vertical suspension sleeve which surrounds the fixed charging duct and is provided at its lower end with a horizontal flange. The latter carries the bearings for the suspension of the chute and the gear transmission on its upper surface.

The gear transmission is advantageously symmetrical with respect to a symmetry plane of the two suspension bearings. It comprises a worm drive or an equivalent system of gears having an input shaft and an output shaft perpendicular to each other. The worm drive has the particular advantage that it can easily be designed to be self-locking, so that the torque due to the weight of the chute will not be taken up by the second rotor.

When the device according to the invention is installed in a furnace, it will advantageously include a casing provided at its lower end with a fixed screen. This screen is then provided with a circular opening into which a flange of said first rotor is fitted. A gas injection pipe is positioned along said circular opening so as to be able to inject a cooling gas into a hollow space of the flange. A cooling system for the device may also include a cooling circuit positioned in an annular space between said first rotor and the fixed vertical charging duct used to pour the material in bulk into the chute.

Figure 2:
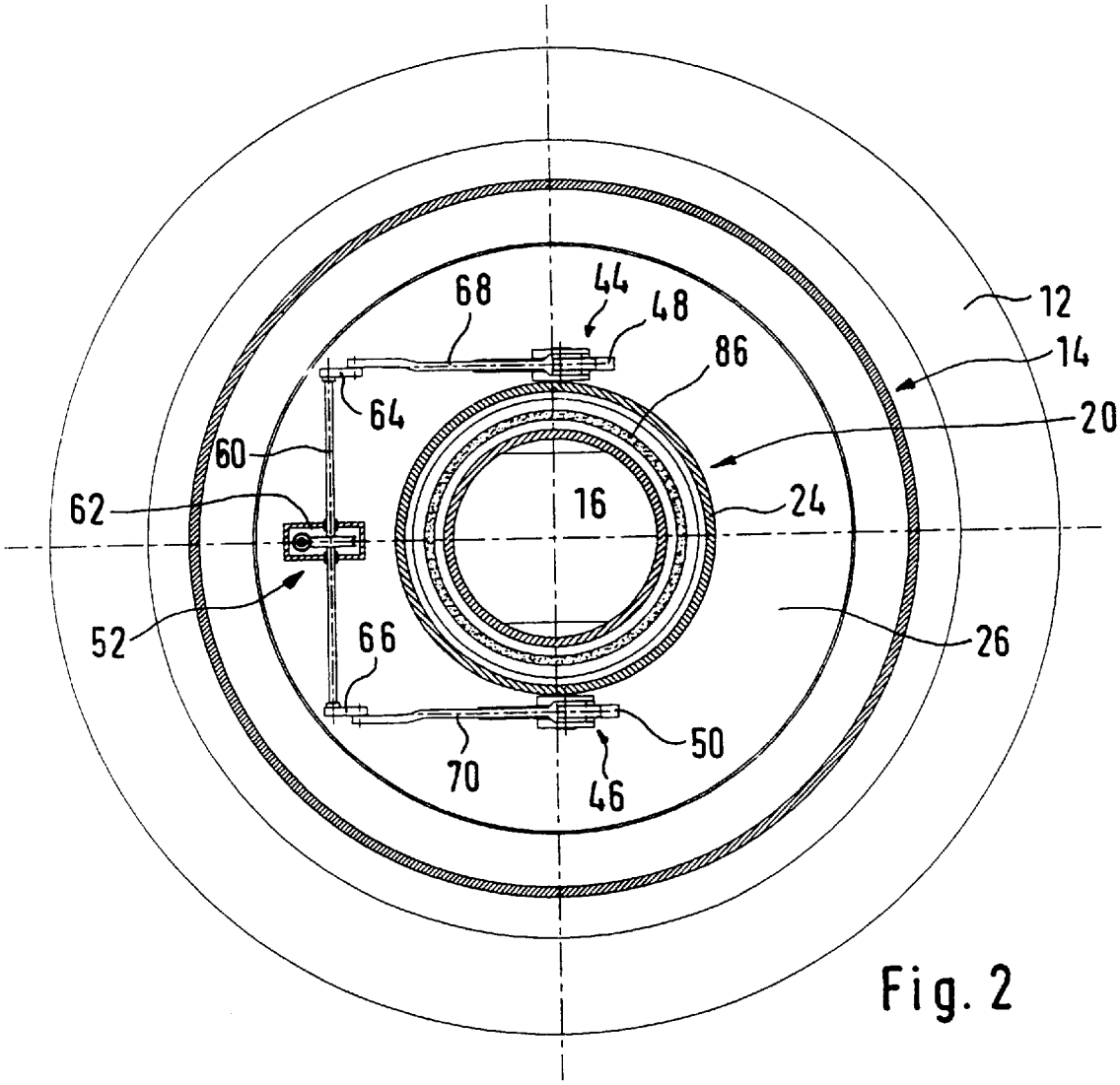

Other special features and characteristics of the invention will emerge from the detailed description of an advantageous embodiment, described below as an illustrative example, referring to the appended drawings. These show:

FIG. 1: a vertical cross-section through a device for the distribution of materials in bulk according to the invention; and FIG. 2: a horizontal cross-section through the line labelled 2—2 in FIG. 1.

The device for distributing materials in bulk 10 shown in the figures is more particularly intended to form part of a feeding device for a shaft furnace, such as a blast furnace, represented schematically by its upper end 12.

The device 10 comprises an outer casing 14, which is mounted in an impervious manner on the upper end 12 of the shaft furnace. This casing 14 is provided with a fixed charging duct 16, which is substantially coaxial with the vertical axis 18 of the shaft furnace. In the casing 14, a first rotor 20 is suspended by means of a first large-diameter roller ring 22. This first rotor 20 comprises a vertical suspension sleeve 24, which surrounds the fixed charging duct 16 and is provided, at its lower end, with a horizontal flange 26. A second large-diameter roller ring 28 is used to suspend the second rotor 30 in the casing 14. This second rotor 30 surrounds the first rotor 20, and its rotation axis is coaxial with the rotation axis of the first rotor 20.

The two rotors 20 and 30 are driven in rotation about their common rotation axis by a driving device denoted in general in FIG. 1 by the reference number 32. It comprises a first pinion 34, which meshes with an annular gear 36 of the first rotor 20, and a second pinion 38, which meshes with an annular gear 40 of the second rotor 30. With the help of two motors 41 and a differential mechanism 43, which are installed outside the casing 14, this driving mechanism 32 is suitable for driving the two rotors 20, 30 either with perfectly synchronised rotational speeds or with different rotational speeds.

The reference number 42 denotes a chute for the distribution of materials in bulk through the charging duct 16. This chute 42 is suspended from the first rotor 20 by means of two suspension bearings 44, 46 so that it can pivot about a substantially horizontal pivoting axis. The suspension bearings 44, 46 are positioned on the flange 26 of the first rotor 20 on either side of its suspension sleeve 24. At the level of each of its suspension bearings 44, 46, the chute 42 is equipped with a pivoting lever 48, 50 protruding upwards with respect to the suspension bearings 44, 46.

The reference number 52 denotes in a general way a gear transmission carried by the flange 26 of the first rotor 20. This transmission 52 comprises an input shaft 54, which is parallel to the rotation axis of the two rotors 20, 30 and which is provided with a pinion 56 which meshes with an annular gear 58 of the second rotor 30. It also comprises an output shaft 60, which is itself parallel to the pivoting axis of the chute 42, and comprises two free ends, each of which is equipped with a crank 64, 66. A worm drive 62 interconnects the input shaft 54 and the output shaft 60, so as to convert a rotation of the vertical input shaft 54 into a rotation of the horizontal output shaft 60. Two connecting rods 68, 70 connect the two cranks 64, 66 symmetrically to the pivoting levers 48, 50 of the chute 42. It follows that a rotation of the input pinion 56 of the gear transmission 52 produces a rotation of the cranks 64, 66, which is converted by the connecting rods 68, 70 and the pivoting levers 48, 50 into a pivoting of the chute 42. Now, the input pinion 56 rotates if there is a difference of angular speed between the first rotor 20 and the second rotor 30. To make the chute 42 pivot from a first inclined position into a second inclined position, it is therefore sufficient to drive the second rotor 30 at an angular speed different from the first rotor 20. To make the chute rotate with a constant angle of inclination, it is sufficient to drive the second rotor 30 with the same angular speed as the first rotor 20. It should be appreciated that the device described makes it possible, with a relatively simple and compact equipment, to transmit appreciable pivoting forces to the chute 42.

It remains to indicate a few important details about the protection of the distribution device 10 against the heat prevailing inside the furnace 12. It should first be noted that the flange 26 of the first rotor 20 is positioned with a small working clearance in a circular opening in a lower screen 72 of the casing 14. This lower screen 72 is provided with insulation 74 and with a closed cooling circuit 76. The flange 26 itself is provided on its lower side with insulation 80 which is separated from the upper metallic flange 26 by a hollow space 82 open at the side. This hollow space 82 is cooled by injecting a gas through a circular duct 84, which is positioned along the edge of the circular opening in the lower screen 72. The first rotor 20 is advantageously cooled by a cooling circuit 86 positioned in the annular space remaining between the sleeve 24 of the first rotor 20 and the fixed charging duct 16. The annular space in which the second rotor 30 and the gear transmission 52 are placed is advantageously cooled by injection of a gas.

What is claimed is:

1. Device for distributing materials in bulk comprising:

a chute (42);

a first rotor (20) with a substantially vertical rotation axis carrying two suspension bearings (44, 46), said chute (42) being suspended in these two suspension bearings (44, 46) so that it can pivot about a substantially horizontal pivoting axis;

a second rotor (30) with a rotation axis coaxial with said first rotor (20), this second rotor (30) being equipped with an annular gear (58);

a gear transmission (52) carried by said first rotor (20), said gear transmission (52) comprising:

an input shaft (54), which is provided with a pinion (56) which meshes with the annular gear (58) of said second rotor (30);

an output shaft (60), which is parallel to the pivoting axis of the chute (42) and with which is associated a crank and connecting rod system producing a pivoting of the chute (42) when said input shaft (54) is driven by the annular gear (58) of said second rotor (30);

characterised in that said output shaft (60) comprises two cranks;

said chute (42) is provided with a pivoting lever (48, 50) at the level of each of its two suspension bearings (44, 46); and each of these two pivoting levers (48, 50) is symmetrically connected by means of a connecting rod to one of the two cranks (64, 66).

2. Device according to claim 1, characterised by:

a vertical charging duct;

said first rotor (20) comprising a vertical suspension sleeve which surrounds said vertical charging duct and is provided, at its lower end, with a horizontal flange;

said suspension bearings (44, 46) of the chute (42) being positioned on said flange on either side of said suspension sleeve;

said gear transmission (52) being mounted on said horizontal flange between said suspension bearings (44, 46).

3. Device according to claim 1, characterised in that said gear transmission (52) is symmetrical with respect to a plane of symmetry of the two suspension bearings (44, 46).

4. Device according to claim 1, characterised in that said gear transmission (52) includes a worm drive (62).

5. Device according to claim 1, characterised by:

a casing (14) provided at its lower end with a fixed screen (72), said fixed screen (72) being provided with a circular opening, and said first rotor (20) being equipped at its lower end with a flange (26) which is fitted into said circular opening with a certain amount of play; and a gas injection pipe (84) positioned along said circular opening so that it can inject a cooling gas into a hollow space (82) in said flange.

6. Device according to claim 1, characterised by:

a fixed charging duct (16) surrounded by said first rotor (20); and by a cooling circuit (86) positioned in an annular space between said first rotor (20) and said fixed charging duct (16).

* * * * *